US011413675B2

(12) United States Patent
He et al.

(10) Patent No.: US 11,413,675 B2
(45) Date of Patent: Aug. 16, 2022

(54) METHOD AND DEVICE FOR MANUFACTURING LARGE-SIZED THIN-WALLED TUBULAR PART BY GAS-LIQUID INTERNAL HIGH PRESSURE FORMING

(71) Applicant: DALIAN UNIVERSITY OF TECHNOLOGY, Liaoning (CN)

(72) Inventors: Zhubin He, Liaoning (CN); Yanan Li, Liaoning (CN); Yanli Lin, Liaoning (CN); Xinyu Hu, Liaoning (CN); Linwei Leng, Liaoning (CN); Shijian Yuan, Liaoning (CN)

(73) Assignee: DALIAN UNIVERSITY OF TECHNOLOGY, Liaoning (CN)

( * ) Notice: Subject to any disclaimer, the term of this patent is extended or adjusted under 35 U.S.C. 154(b) by 0 days.

(21) Appl. No.: 16/937,660

(22) Filed: Jul. 24, 2020

(65) Prior Publication Data

US 2021/0154721 A1 May 27, 2021

(30) Foreign Application Priority Data

Nov. 21, 2019 (CN) ..... 201911148793.0

(51) Int. Cl.
*B21D 26/041* (2011.01)
*B21D 26/045* (2011.01)
*B21D 26/049* (2011.01)

(52) U.S. Cl.
CPC ..... *B21D 26/041* (2013.01); *B21D 26/045* (2013.01); *B21D 26/049* (2013.01)

(58) Field of Classification Search
CPC .. B21D 26/033; B21D 26/039; B21D 26/041; B21D 26/043; B21D 26/045; B21D 26/047; B21D 26/049
See application file for complete search history.

(56) References Cited

U.S. PATENT DOCUMENTS

| | | | | |
|---|---|---|---|---|
| 4,761,982 | A * | 8/1988 | Snyder | B21D 26/043 264/573 |
| 6,067,831 | A * | 5/2000 | Amborn | B21D 26/033 29/421.1 |
| 2001/0022099 | A1* | 9/2001 | Ueno | B21D 22/105 72/57 |
| 2004/0200550 | A1* | 10/2004 | Pfaffmann | B21D 26/047 148/526 |
| 2017/0120317 | A1* | 5/2017 | Ishizuka | B21D 26/047 |

* cited by examiner

*Primary Examiner* — Teresa M Ekiert
(74) *Attorney, Agent, or Firm* — MH2 Technology Law Group, LLP

(57) ABSTRACT

A method and device for manufacturing a large-sized thin-walled tubular part by gas-liquid internal high pressure forming (IHPF). A gas and a liquid are filled at a certain volume ratio into a thin-walled blank. The pressure of the gas-liquid mixed fluid is mainly determined by the gas pressure. During the deformation of the thin-walled blank, due to a large compression ratio of the gas, the gas-liquid pressure will not basically change with the change of the volume of a blank cavity. A support pressure on the cavity of the thin-walled blank is stable in the entire forming process. In addition, even if there is a slight leakage of the liquid or gas during the forming process, the medium pressure inside the blank will not fluctuate largely. In this way, embodiments lower the requirements for the sealing effect during the tubular part forming process.

1 Claim, 3 Drawing Sheets

METHOD AND DEVICE FOR MANUFACTURING LARGE-SIZED THIN-WALLED TUBULAR PART BY GAS-LIQUID INTERNAL HIGH PRESSURE FORMING

CROSS REFERENCE TO RELATED APPLICATIONS

This application claims priority under 35 U.S.C. § 119 to Chinese Patent Application No. 201911148793.0, which was filed on 21 Nov. 2019, the contents of which is hereby expressly incorporated by reference in its entirety.

TECHNICAL FIELD

The present invention relates to the technical field of tubular part forming, and in particular, to a method and device for manufacturing a large-sized thin-walled tubular part by gas-liquid internal high pressure forming (IHPF).

BACKGROUND

Lightweight components are an important way to improve fuel efficiency and reduce energy consumption in aviation, aerospace, automotive, high-speed rail and other fields. The lightweight design is realized by lightweight structures and lightweight materials. Lightweight structures generally refer to optimized integral components with complex shaped sections and curved axes. Lightweight materials mainly refer to aluminum alloys, magnesium alloys, titanium alloys, high-strength steel and other materials with high specific strength. Currently, there are many complex integral components which are made of lightweight materials and structurally lightweight.

As for complex integral tubular parts with closed cross sections, conventional rigid dies cannot apply a forming force from inside the blank to deform it. The use of high-pressure fluid media with good fluidity to perform pressure bulging from the inside of the blank is an ideal forming technique, which is commonly referred to as IHPF. According to the different fluid media used, the internal high-pressure forming is divided into normal temperature hydroforming and hot gas forming. Normal temperature hydroforming applies to materials with good deformation properties at room temperature, such as low carbon steel and high strength steel. The liquid pressure used for forming reaches 400 MPa or even higher. At present, hydroforming has been used for the mass production of complex shaped tubular parts in the automobile and other industries. Hot gas forming applies to materials with poor plasticity at room temperature, such as aluminum alloys, magnesium alloys and titanium alloys. In the hot gas forming process, the blank is heated to a suitable temperature before forming, and the gas pressure required at different speeds is significantly different. In case of slow forming, for example, in the conventional superplastic forming (SPF) process, the gas pressure is generally lower than 3 MPa. In case of fast forming, for example, the part needs to be formed in 30 s or less, the gas pressure can reach 35 MPa or even higher.

The material is subjected to an elongation deformation in the circumferential direction under high pressure in either of the normal temperature IHPF process or the hot gas forming process. In order to achieve a more complex cross-sectional shape and a larger cross-sectional change of the formed part, a greater pressure of the forming medium and a more complicated die/tooling are required. Especially, when there are local small features on the part, it is more necessary to achieve local bulging by increasing the medium pressure in the late forming stage. In practical applications, there are a large number of parts with complicated cross-sectional shapes but small changes in the perimeter of each cross section, which are designed with reduced forming difficulty. These parts do not need the blank to undergo a large elongation deformation in the circumferential direction, so there is no need to use high-pressure liquid or gas bulging.

A method for forming the components with complicated cross-sectional shapes but small changes in the perimeter of each cross section is called "pressure-filled pressing". In this method, a medium of certain pressure fills the thin-walled blank to improve the structural stability of the thin-walled blank. Then a rigid die is used to actively press the thin-walled blank from the outside, and the entire tubular part is deformed mainly in the cross-sectional shape, so as to finally obtain the desired part. Patent No. 1, ZL201610147348.2, proposes a method for hydraulically forming a shaped blank with a variable cross section. In this method, a liquid of certain pressure fills the blank for pressing, and the blank used is a simple blank with a circular cross-section or a blank that has undergone simple bulging. Patent No. 2, ZL201610825458.X, proposes a method for forming a shaped blank with a large cross-sectional change by integrating bulging and pressing. This method simultaneously completes the bulging and pressing of the blank in one forming step. In the "pressure-filled pressing" forming techniques, the pressure of the filled medium plays a decisive role in shaping the final part. In other words, the smooth shaping of the final part depends on the pressure of the medium that fills the blank. If the pressure is too small or too large, defects such as wrinkles and undercuts will appear. In practice, when a liquid medium is used, since the liquid is almost incompressible, a slight leakage of the liquid medium in the blank will cause a sharp drop in the liquid pressure. If the volume of the blank cavity becomes smaller during the pressing process, a sharp rise in the liquid pressure will also occur. For a large-sized thin-walled blank, due to the difficulty in sealing the ends of the shaped thin-walled blank, it is difficult to accurately control the liquid volume and pressure in the blank. When a gas medium is used, the gas pressure in the blank does not fluctuate greatly due to a slight leakage of the gas or a slight change in the volume of the blank cavity, so the gas pressure in the blank is stable. However, when the blank cavity has a large volume which requires a high gas pressure, it will take a long time to fill and release the high-pressure gas. Therefore, the "gas-filled pressing" method has low production efficiency in the forming of large-sized thin-walled blanks. In addition, the preparation and control of the high-flow high-pressure gas both require special equipment and high costs.

In summary, the existing "pressure-filled pressing" methods for forming large-sized thin-walled blanks have low efficiency and high cost. In these methods, the pressure drops sharply due to the leakage of the liquid inside the blank or rises sharply due to the compression of the liquid, and it takes a long time to fill the blank with the gas due to a large gas compression ratio. Therefore, there is a need for a new hydroforming method for manufacturing a large-sized thin-walled tubular part.

SUMMARY

In order to solve the above problems existing in the prior art, an objective of the present invention, among others, is to provide a method and device for manufacturing a large-sized thin-walled tubular part by gas-liquid internal high pressure forming (IHPF). At least one embodiment of the present invention realizes pressure stabilization during the forming process of the thin-walled tubular part without the need for intermediate adjustment and avoids pressure fluctuations even if part of a pressure medium leaks.

To achieve the above purpose, at least one embodiment of the present invention provides the following technical solutions.

A method for manufacturing a large-sized thin-walled tubular part by gas-liquid IHPF includes the following steps:

step 1, determining an internal pressure: analyzing a characteristic of a part to be formed, and determining an internal support pressure for forming;

step 2, calculating a volume: calculating a cavity volume of a blank and a change in the volume during the entire forming process;

step 3, determining a gas-liquid volume ratio: determining a sequence and a volume ratio of a gas medium and a liquid medium filling the blank according to the change in the cavity volume of the blank;

step 4, placing the blank: placing the large-sized thin-walled blank to be formed on a die, and closing the die to a certain position;

step 5, sealing an end: sealing an end of the blank;

step 6, filling the liquid: filling a certain volume of liquid into the blank;

step 7, filling the gas: filling the gas into the blank to a set pressure of the blank;

step 8, closing the die for forming: closing the die completely to deform the blank, and monitoring the internal pressure of the blank in real time;

step 9, adjusting the pressure: adjusting the pressure by filling or discharging the gas or liquid, when the internal pressure of the blank exceeds or falls below the set pressure;

step 10, releasing the pressure: keeping the die closed after the forming is completed, and quickly releasing the gas to release the pressure in the blank;

step 11, opening the die to obtain a tubular part: opening the die, and taking out a formed tubular part.

A device for manufacturing a large-sized thin-walled tubular part by gas-liquid IHPF includes a die, a liquid filling device and a gas filling device, where the liquid filling device and the gas filling device are used to fill a liquid and a gas into a blank, respectively.

Preferably, the die includes an upper die, a lower die, a left pressure pad and a right pressure pad; the upper die is provided on the top of the lower die; an upper die shoe is provided on the top of the upper die, and a lower die shoe is provided at the bottom of the lower die; the left pressure pad and the right pressure pad are provided on both sides of the upper die, respectively.

Preferably, the liquid filling device includes a liquid storage tank and a first punch; the liquid storage tank is connected to the first punch through a pipe; the first punch fills the blank with the liquid from the liquid storage tank.

Preferably, the gas filling device includes a gas storage tank and a second punch; the gas storage tank is connected to the second punch through a pipe; the second punch fills the blank with the gas from the gas storage tank.

Compared with the prior art, various embodiments of the present invention achieve the following beneficial effects:

The method and device for manufacturing a large-sized thin-walled tubular part by gas-liquid IHPF provided by embodiments of the present invention fill a thin-walled blank with gas and a liquid at a certain volume ratio. The pressure of the gas-liquid mixed fluid is mainly determined by the gas pressure. The shape of the thin-walled blank is changed with the change in the volume of a blank cavity. When the thin-walled blank is deformed, due to a large compression ratio of the gas, the pressure of the gas and the liquid basically will not change with the change in the volume of the blank cavity. The support pressure on the cavity of the thin-walled blank is stable in the entire forming process. This avoids the forming defects such as wrinkles and undercuts on the thin-walled blank caused by the sharp rise or drop in the internal support pressure during a conventional "liquid-filled pressing" process performed only with a liquid medium. It also avoids the difficulty of controlling the liquid volume and pressure in real time in order to maintain a stable internal support pressure of the blank in a conventional "liquid-filled pressing" process. In addition, even if there is a slight leakage of the liquid or gas during the forming process, the medium pressure inside the blank will not have large fluctuations. In this way, various embodiments of the present invention lower the requirements for the sealing effect during the tubular part forming process, and improves the stability and success rate of the forming process.

BRIEF DESCRIPTION OF DRAWINGS

To describe the technical solutions in the examples of the present invention or in the prior art more clearly, the following briefly introduces the accompanying drawings required for describing the examples. Apparently, the accompanying drawings in the following description merely show some examples of the present invention, and a person of ordinary skill in the art may still derive other drawings from these accompanying drawings without creative efforts.

Figure 1:
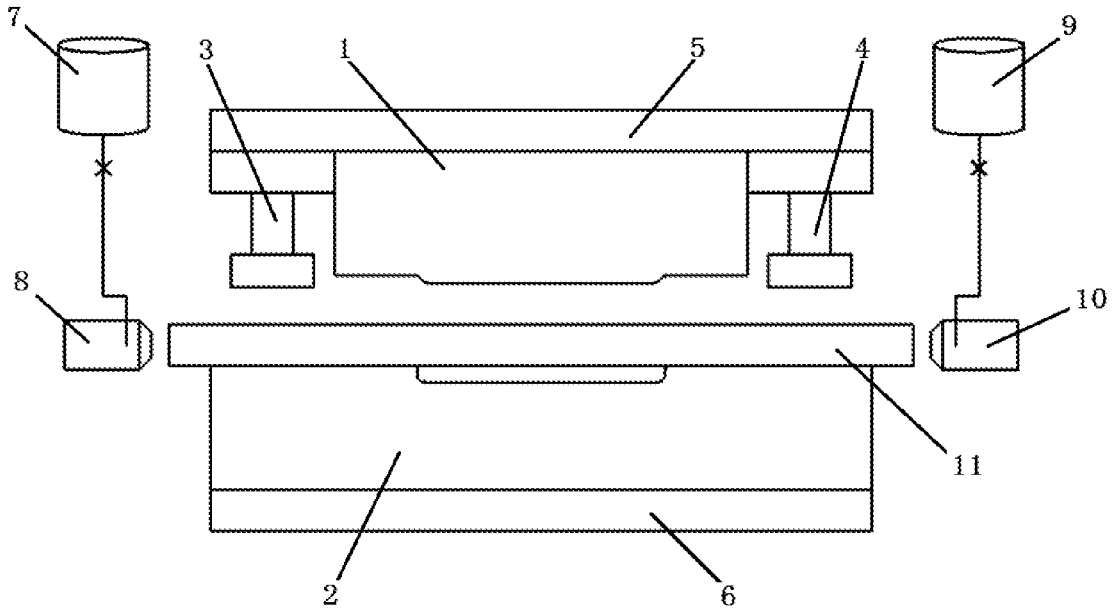
FIG. 1 is a structural diagram for step 4 of a method for manufacturing a large-sized thin-walled tubular part by gas-liquid IHPF according to an embodiment of the present invention.

Reference Numerals: 1. upper die, 2. lower die, 3. left pressure pad, 4. right pressure pad, 5. upper die shoe, 6. lower die shoe, 7. liquid storage tank, 8. first punch, 9. gas storage tank, 10. second punch, 11. blank, 12. liquid, and 13. gas.

DETAILED DESCRIPTION

The following clearly and completely describes the technical solutions in the examples of the present invention with reference to the accompanying drawings in the examples of the present invention. Apparently, the described examples are merely some rather than all of the examples of the present invention. All other examples obtained by a person of ordinary skill in the art based on the examples of the present invention without creative efforts shall fall within the protection scope of the present invention.

One objective of the present invention is to provide a method and device for manufacturing a large-sized thin-walled tubular part by gas-liquid IHPF, so as to solve the problems existing in the prior art.

To make the above objectives, features, and advantages of the present invention more obvious and easy to understand, embodiments and examples of the present invention will be further described in detail with reference to the accompanying drawings and the detailed description.

Example 1

This example provides a method for manufacturing a large-sized thin-walled tubular part by gas-liquid IHPF, including the following steps:

Step 1, determine an internal pressure: analyze a characteristic of a part to be formed, and determine an internal support pressure for forming.

Step 2, calculate a volume: calculate a cavity volume of a blank 11 and a change in the volume during the entire forming process.

Step 3, determine a gas-liquid volume ratio: determine a sequence and a volume ratio of a gas medium and a liquid medium for filling into the blank 11 according to the change in the cavity volume of the blank 11.

Step 4, place the blank 11: place the large-sized thin-walled blank 11 to be formed on a die, and close the die to a certain position, as shown in FIG. 1.

Figure 2:
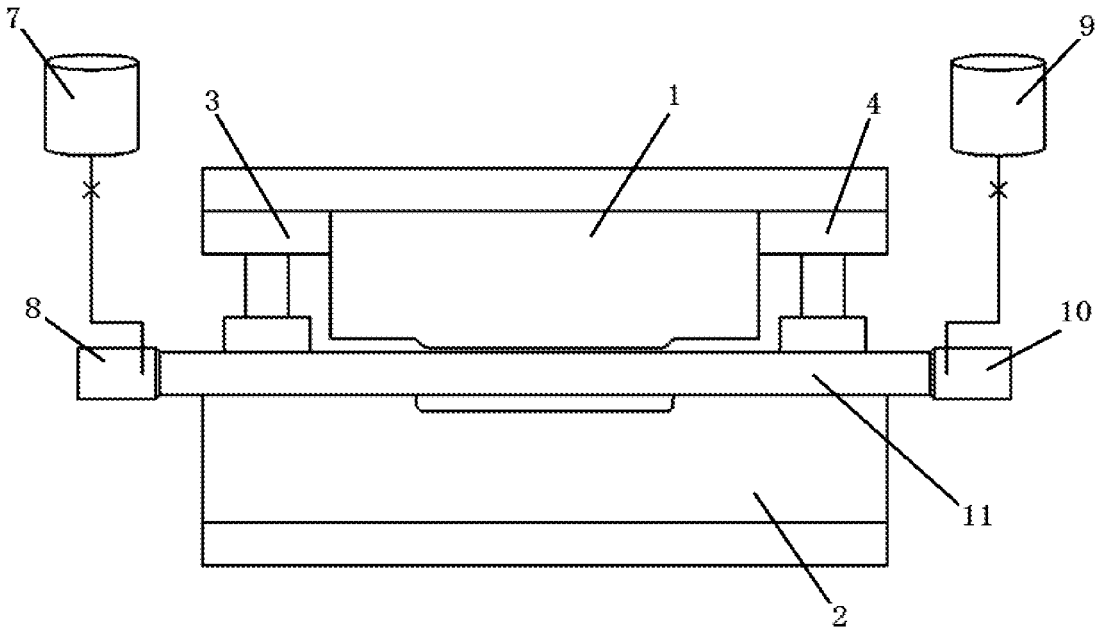
FIG. 2 is a structural diagram for step 5 of a method for manufacturing a large-sized thin-walled tubular part by gas-liquid IHPF according to an embodiment of the present invention.

Step 5, seal an end: seal an end of the blank 11, as shown in FIG. 2.

Figure 3:
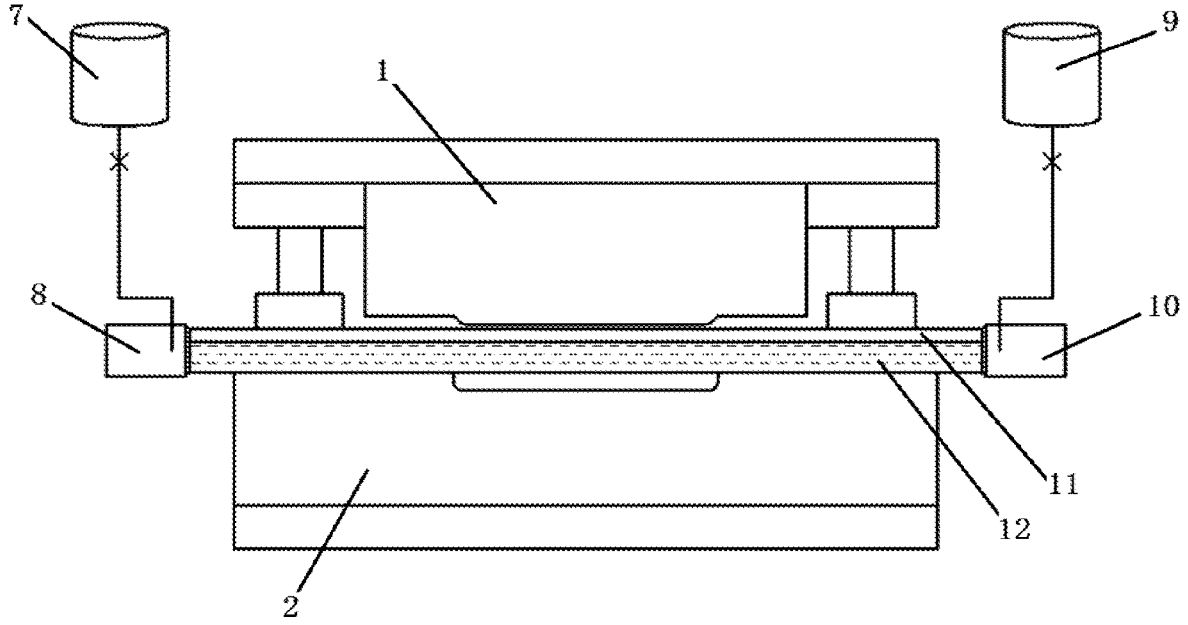
FIG. 3 is a structural diagram for step 6 of a method for manufacturing a large-sized thin-walled tubular part by gas-liquid IHPF according to an embodiment of the present invention.

Step 6, fill the liquid: fill the blank 11 with a certain volume of liquid 12, as shown in FIG. 3.

Figure 4:
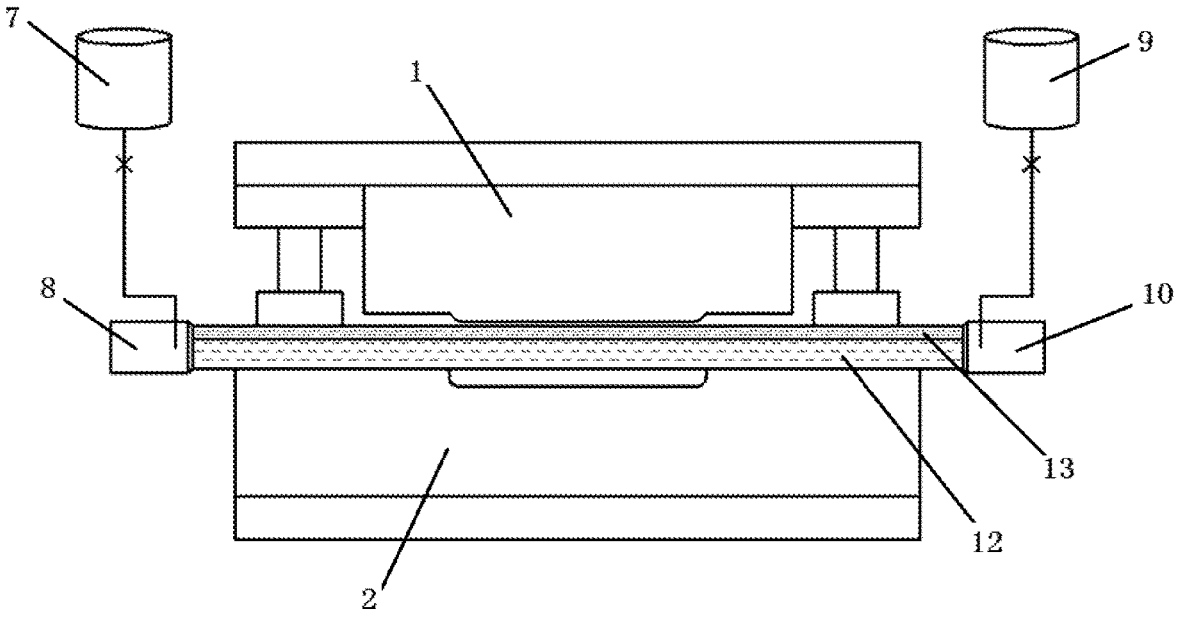
FIG. 4 is a structural diagram for step 7 of a method for manufacturing a large-sized thin-walled tubular part by gas-liquid IHPF according to an embodiment of the present invention.

Step 7, fill the gas: fill the blank 11 with the gas 13 until a set pressure is achieved in the blank 11, as shown in FIG. 4.

Figure 5:
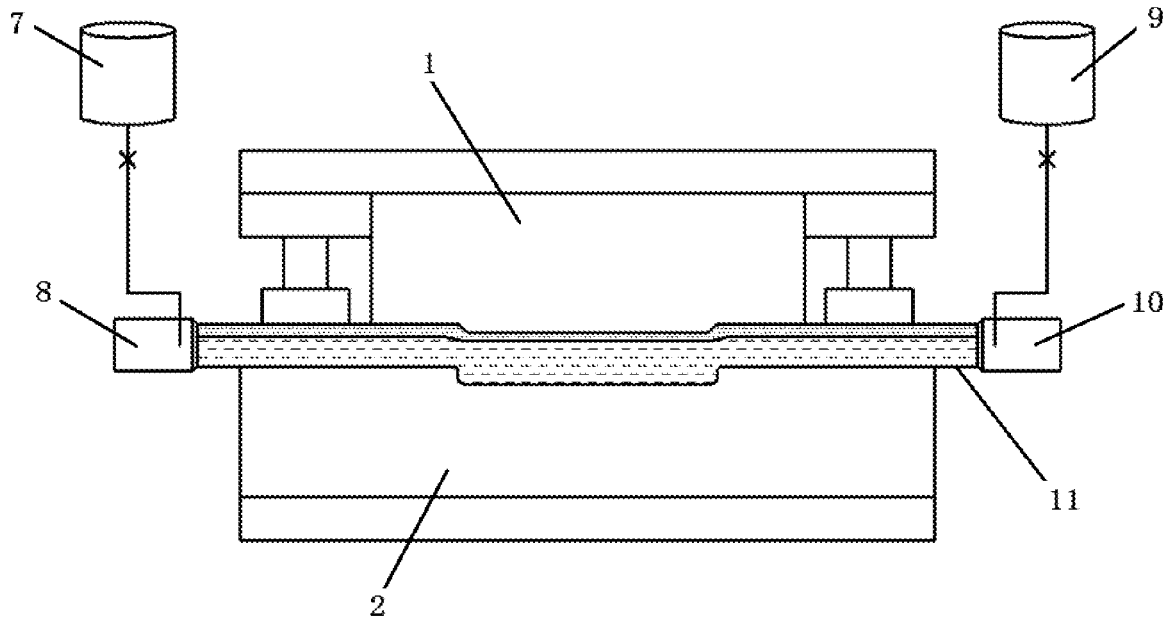
FIG. 5 is a structural diagram for step 8 of a method for manufacturing a large-sized thin-walled tubular part by gas-liquid IHPF according to an embodiment of the present invention.

Step 8, close the die for forming: close the die completely to deform the blank 11, and monitor the internal pressure of the blank 11 in real time, as shown in FIG. 5.

Step 9, adjust the pressure: adjust the pressure by filling the blank 11 with or discharging from the blank 11 the gas or liquid, when the internal pressure of the blank 11 exceeds or falls below the set pressure.

Step 10, release the pressure: keep the die closed after the forming is completed, and quickly release the gas to release the pressure in the blank 11.

Step 11, open the die to obtain a tubular part: open the die, and take out a formed tubular part.

Example 2

As shown in FIG. 4, this example provides a device for manufacturing a large-sized thin-walled tubular part by gas-liquid IHPF, applied to the method for manufacturing a large-sized thin-walled tubular part by gas-liquid IHPF in Example 1. The forming device specifically includes a die, a liquid filling device and a gas filling device. The liquid filling device and the gas filling device are used to fill a blank 11 with a liquid and a gas, respectively. The die includes an upper die 1, a lower die 2, a left pressure pad 3 and a right pressure pad 4. The upper die 1 is provided on the top of the lower die 2. An upper die shoe 5 is provided on the top of the upper die 1, and a lower die shoe 6 is provided at the bottom of the 5 lower die 2. The left pressure pad 3 and the right pressure pad 4 are provided on both sides of the upper die 1, respectively. The liquid filling device includes a liquid storage tank 7 and a first punch 8. The liquid storage tank 7 is connected to the first punch 8 through a pipe. The first punch 8 fills the blank 11 with the liquid from the liquid storage tank 7. The gas filling device includes a gas storage tank 9 and a second punch 10. The gas storage tank 9 is connected to the second punch 10 through a pipe. The second punch 10 fills the blank 11 with the gas from the gas storage tank 9. In this example, the first punch 8 and the second punch 10 are respectively connected to both ends of the blank 11, which realizes the filling of the liquid or gas and seals the both ends of the blank 11.

Example 3

This example provides a method for manufacturing a large-sized thin-walled tubular part by gas-liquid IHPF. In step 2, the cavity volume of the blank and the cavity volume of the final part are calculated, but the change in the volume during the entire forming process is not calculated. Other steps are the same as those of Example 1.

This example has the beneficial effect that it is not necessary to calculate the volume change of the large-sized tubular part in the entire process or to adjust the pressure in real time. For a large-sized thin-walled tubular part, the cavity volume of the blank reaches 100 L or more, and the change in the cavity volume of the blank during the press forming process is only 10-20% of the raw volume. Because the gas compression ratio is large, the relative change of the gas pressure in the blank cavity is only 10-25%. Such a change in the gas pressure will not adversely affect the forming process, so there is no need to adjust the support pressure in real time based on the volume change of the blank cavity during the entire forming process.

Example 4

This example provides a method for manufacturing a large-sized thin-walled tubular part by gas-liquid IHPF. In step 6, about 50-100 L of liquid is filled into the blank. Other steps are the same as those of Example 1.

This example has the beneficial effect that the large-sized tubular part uses the liquid to occupy a space and the gas to provide pressure, which realizes high efficiency and a low cost. A large volume of liquid is first filled into the large-sized thin-walled tubular part and then the gas is filled into the remaining space of the tubular part. That is, the liquid first occupies most of the space and then the gas is filled to provide a support pressure. In this way, this example of the present invention solves the problems of long gas filling and releasing time and low production efficiency caused by a large volume and a high gas pressure in the blank cavity during a "gas-filled pressing" process which uses only gas for internal support. In addition, this example of the present invention also avoids the preparation and control of high-pressure high-flow gas, thereby saving investment in equipment and usage costs.

Example 5

This example provides a method for manufacturing a large-sized thin-walled tubular part by gas-liquid IHPF. In step 6, the liquid filled into the blank is water or an emulsion, and the volume of the liquid is 50-75% the cavity volume of the blank. Other steps are the same as those of Example 1.

This example has the beneficial effect that the gas volume is large and the internal support pressure is stable. Because the volume of the gas filled into the blank cavity is large, the internal support pressure of the blank remains basically unchanged in the process of closing the die to deform the blank. When it is not necessary to use a variable internal support pressure to form a part, this solution solves the problem regarding a sharp drop or rise in the pressure due to liquid leakages or compression in a conventional method which uses only liquid for support. In addition, this solution completes the process of closing the die for forming at a fast speed in 3-5 seconds, improving the efficiency.

Example 6

This example provides a method for manufacturing a large-sized thin-walled tubular part by gas-liquid IHPF. In step 6, the liquid placed into the blank is water or an emulsion, and the volume of the liquid is 80-90% the cavity volume of the blank. Other steps are the same as those of Example 1.

This example has the beneficial effect that the gas volume is small and the pressure can be adjusted quickly. The volume of the liquid placed in the blank cavity is larger than the volume of the gas placed in the blank cavity. Therefore, when a small amount of gas is directly added or released, the support pressure of the blank cavity can be adjusted to a large extent, and the pressure adjustment is stable and accurate. In this way, this example of the present invention solves the problem regarding difficulty in achieving precise pressure adjustment by adding to or discharging from the blank a liquid when only the liquid is used for support.

Example 7

This example provides a method for manufacturing a large-sized thin-walled tubular part by gas-liquid IHPF. In step 9, the liquid is discharged or added from the bottom of the cavity of the thin-walled blank, or the gas is discharged or added from an upper portion, and the cavity pressure is adjusted by changing the liquid volume or directly changing the gas pressure. Other steps are the same as those of Example 1.

This example has the beneficial effect that the internal pressure is adjusted accurately and in real time during the entire forming process, which meets the requirements for forming a complex part. The cavity of the thin-walled blank is simultaneously filled with a gas and a liquid according to a certain volume ratio. Because the gas has a large compression ratio, the pressure of the cavity can be smoothly adjusted by changing the liquid volume to changing the volume and pressure of the gas, or directly changing the gas pressure. In this way, this example of the present invention solves the problem that when only the liquid is used for internal support, it is difficult to precisely adjust the pressure by changing the liquid volume because the liquid is almost incompressible. Meanwhile, during the entire forming process, the support pressure in the blank cavity can be adjusted quickly or slowly, and can be gradually changed according to a specific curve, which provides the possibility for forming a complex thin-walled tubular part.

Several examples are used for illustration of the principles and implementation methods of the present invention. The description of the examples is used to help illustrate the method and the core principles of the present invention. In addition, those skilled in the art can make various modifications in terms of specific examples and scope of application in accordance with the teachings of the present invention. In conclusion, the content of this specification shall not be construed as a limitation to the present invention.

What is claimed is:

1. A method for manufacturing a thin-walled tubular part by gas-liquid internal high pressure forming, comprising the following steps:

analyzing a characteristic of the thin-walled part to be formed, and determining an internal support pressure of a blank for formation of the thin walled tubular part;

calculating a cavity volume of the blank and a change in the cavity volume of the blank during the formation;

determining a filling sequence of a gas medium and a liquid medium to be placed into the blank and a volume ratio of the gas medium and the liquid medium to be placed into the blank according to the change in the cavity volume of the blank;

placing the blank on a die, and closing the die to a certain position;

sealing two ends of the blank;

filling a certain volume of the liquid medium into the blank;

filling the gas medium into the blank such that an internal pressure of the blank reaches the internal support pressure of the blank;

closing the die completely to deform the blank, and monitoring the internal pressure of the blank in real time;

adjusting the internal pressure of the blank by adding or discharging the gas medium or the liquid medium, when the internal pressure of the blank exceeds or falls below the internal support pressure of the blank until the thin-walled tubular part is formed;

keeping the die closed until after the thin-walled tubular part is formed, and quickly releasing the gas medium to release the internal pressure of the blank; and opening the die and taking out the thin-walled tubular part that was formed.

* * * * *